US008342145B2

(12) United States Patent
Klotz

(10) Patent No.: US 8,342,145 B2
(45) Date of Patent: Jan. 1, 2013

(54) LIFTER RETAINER

(75) Inventor: James R. Klotz, Clinton Township, MI (US)

(73) Assignee: Chrysler Group LLC, Auburn Hills, MI (US)

( * ) Notice: Subject to any disclaimer, the term of this patent is extended or adjusted under 35 U.S.C. 154(b) by 1590 days.

(21) Appl. No.: 11/372,570

(22) Filed: Mar. 10, 2006

(65) Prior Publication Data

US 2007/0209623 A1 Sep. 13, 2007

(51) Int. Cl.
*F01L 1/14* (2006.01)

(52) U.S. Cl. ..... 123/90.48; 123/90.44; 123/90.55; 74/569

(58) Field of Classification Search ..... 123/90.48, 123/90.5
See application file for complete search history.

(56) References Cited

U.S. PATENT DOCUMENTS

| | | | | |
|---|---|---|---|---|
| 4,765,290 | A * | 8/1988 | Tanaka | 123/90.42 |
| 5,546,899 | A * | 8/1996 | Sperling et al. | 123/90.5 |
| 6,257,189 | B1 * | 7/2001 | Moretz et al. | 123/90.5 |
| 6,978,752 | B2 * | 12/2005 | Albertson et al. | 123/90.5 |
| 6,994,064 | B2 * | 2/2006 | Haas et al. | 123/90.5 |
| 7,086,360 | B1 * | 8/2006 | Schnell et al. | 123/90.5 |

* cited by examiner

*Primary Examiner* — Ching Chang
(74) *Attorney, Agent, or Firm* — Ralph E Smith

(57) ABSTRACT

A lifter retainer including a central body portion connected to both a left bank of lifter retaining arms and a right bank of lifter retaining arms. The lifter retainer may be adapted to engage a key portion of one or more lifters to prevent the lifters from rotating during engine operation.

15 Claims, 5 Drawing Sheets

LIFTER RETAINER

TECHNICAL FIELD

This invention generally relates to engine valve lifters and more particularly relates to valve lifter retainers used on "V" style engines.

BACKGROUND

Most modern internal combustion engine designs use the combination of a cam, lifter, and a push rod to operate the intake and exhaust valves of the engine. Typically, the lifter "rides" against a rotating eccentric lobe of a cam shaft. The eccentricity of the cam shaft lobe raises and lowers (or reciprocates) the lifter/push rod assembly which in turn activates a rocker arm. In turn, the rocker arm acts against the stem portion of the valve to cause the opening and closing of the valve. It is common to use lifters that employ wheels (commonly called "rollers") disposed between the lifter and the cam lobe. These rollers rotate against the cam lobe thereby minimizing friction between the cam lobe and the lifter. Although roller lifters are effective for minimizing friction between the lifter and the cam, the axis of rotation of the roller must stay generally parallel to the axis of rotation of the cam. If these axes are not generally parallel, the roller will not properly engage the cam shaft lobe and the roller may gall the cam lobe. Traditionally, this problem (misalignment of the roller axis and the cam axis) is prevented on "V" style engines by using an alignment structure which engages a keyed portion (such as a flat or the like) on the body of the roller lifters. This keyed alignment structure prevents the roller lifters from rotating within a bore of the block in which they reciprocate.

Present production alignment structures are composed of a plurality of elements. The present invention reduces the number of elements thereby generating cost savings and reducing the possibility of inadvertently omitting a component (which can cause a cam shaft or lifter to prematurely fail).

DETAILED DESCRIPTION

Figure 1:
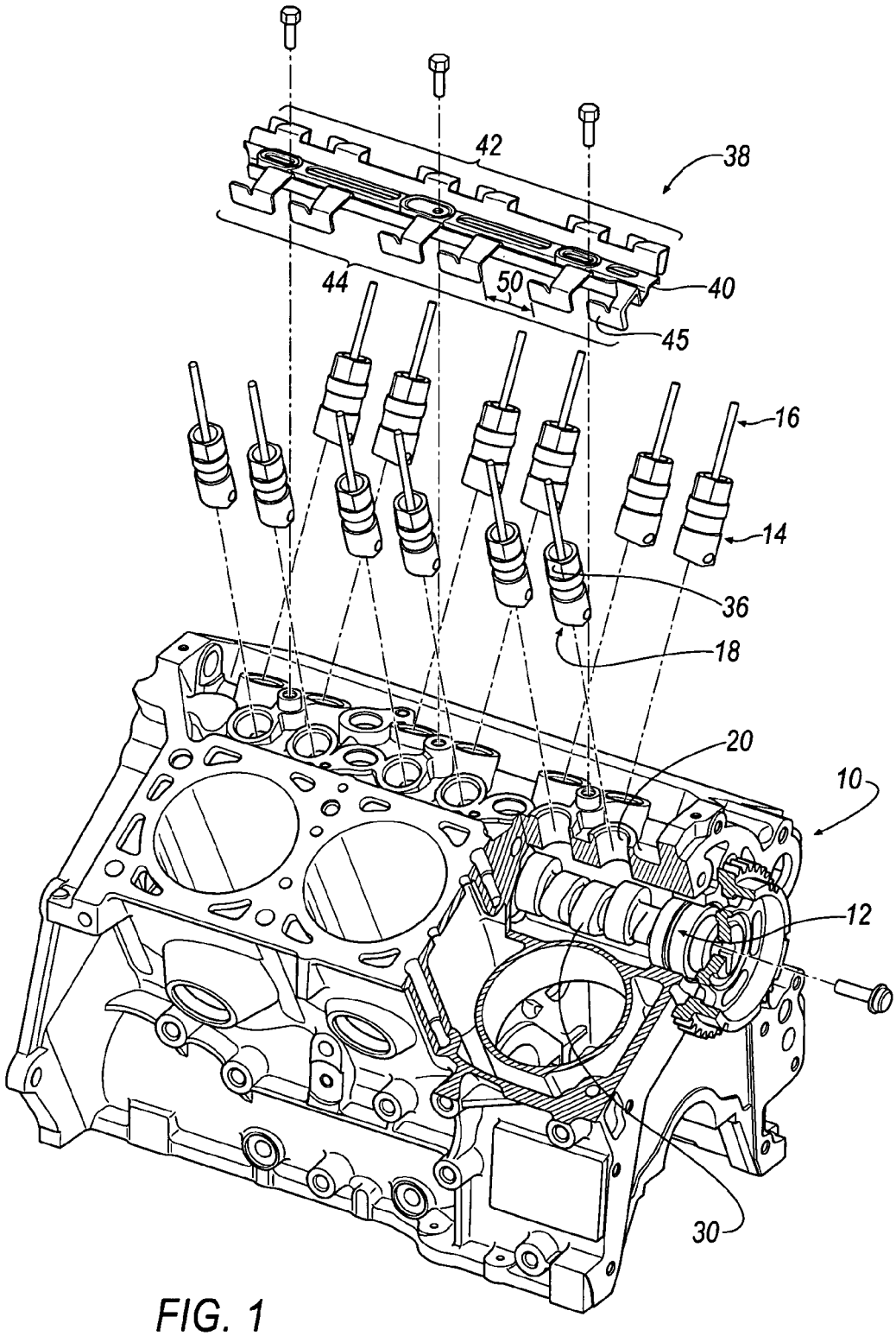
FIG. 1 is a partial exploded view of an engine block employing an embodiment of the lifter alignment system of the present invention.

Now referring to FIG. 1, engine block 10 can house cam shaft 12 and one or more lifters (lifters exemplified at 14 and 18). Each lifter 14 can be respectively coupled to a push rod 16 which in turn is typically coupled to the engine valve (not shown) by way of a rocker arm (not shown).

Figure 2:
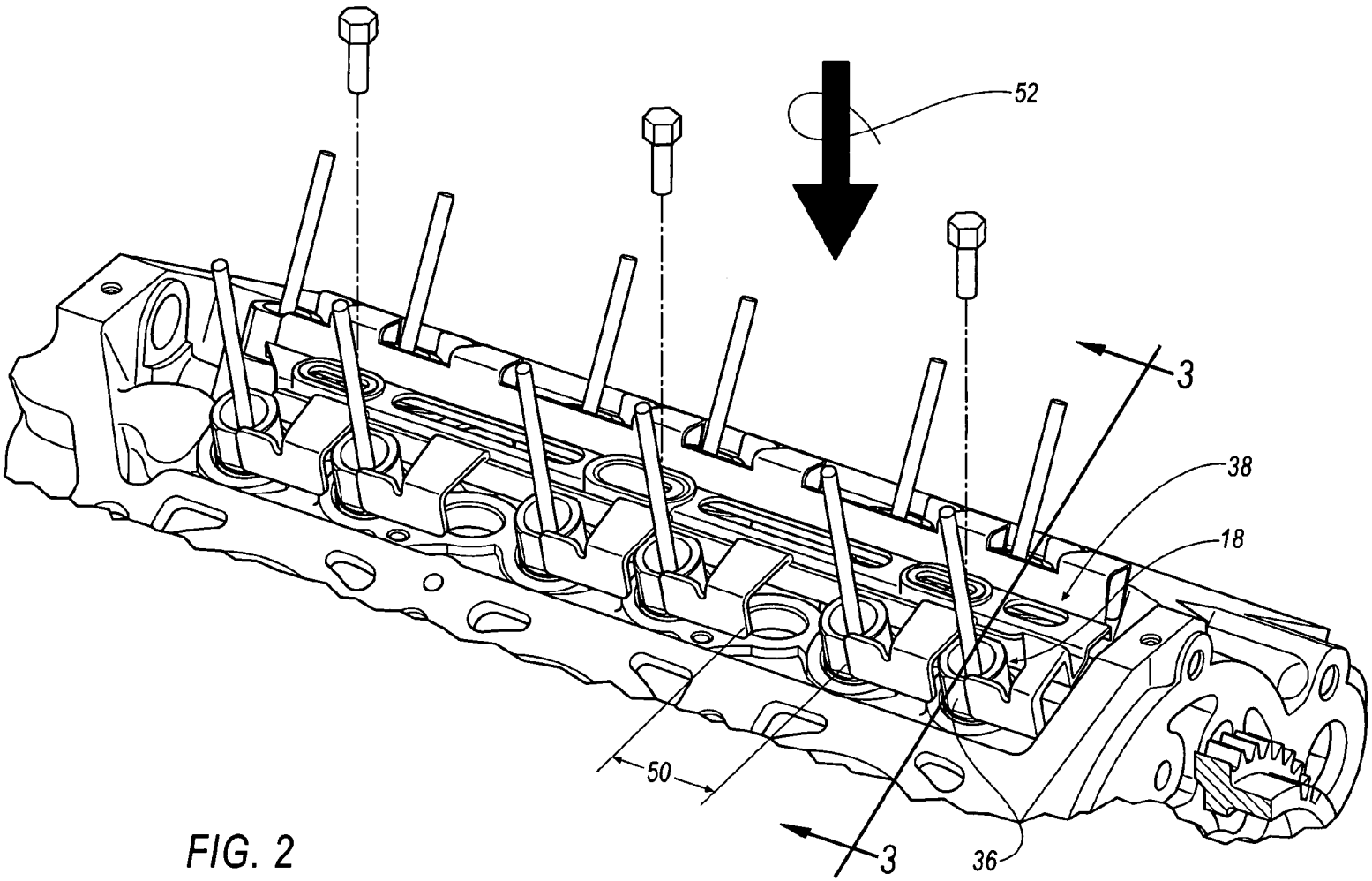
FIG. 2 is a partial view of the top portion of an engine block showing an embodiment of the lifter alignment system of the present invention in a non-locked position.
Figure 3:
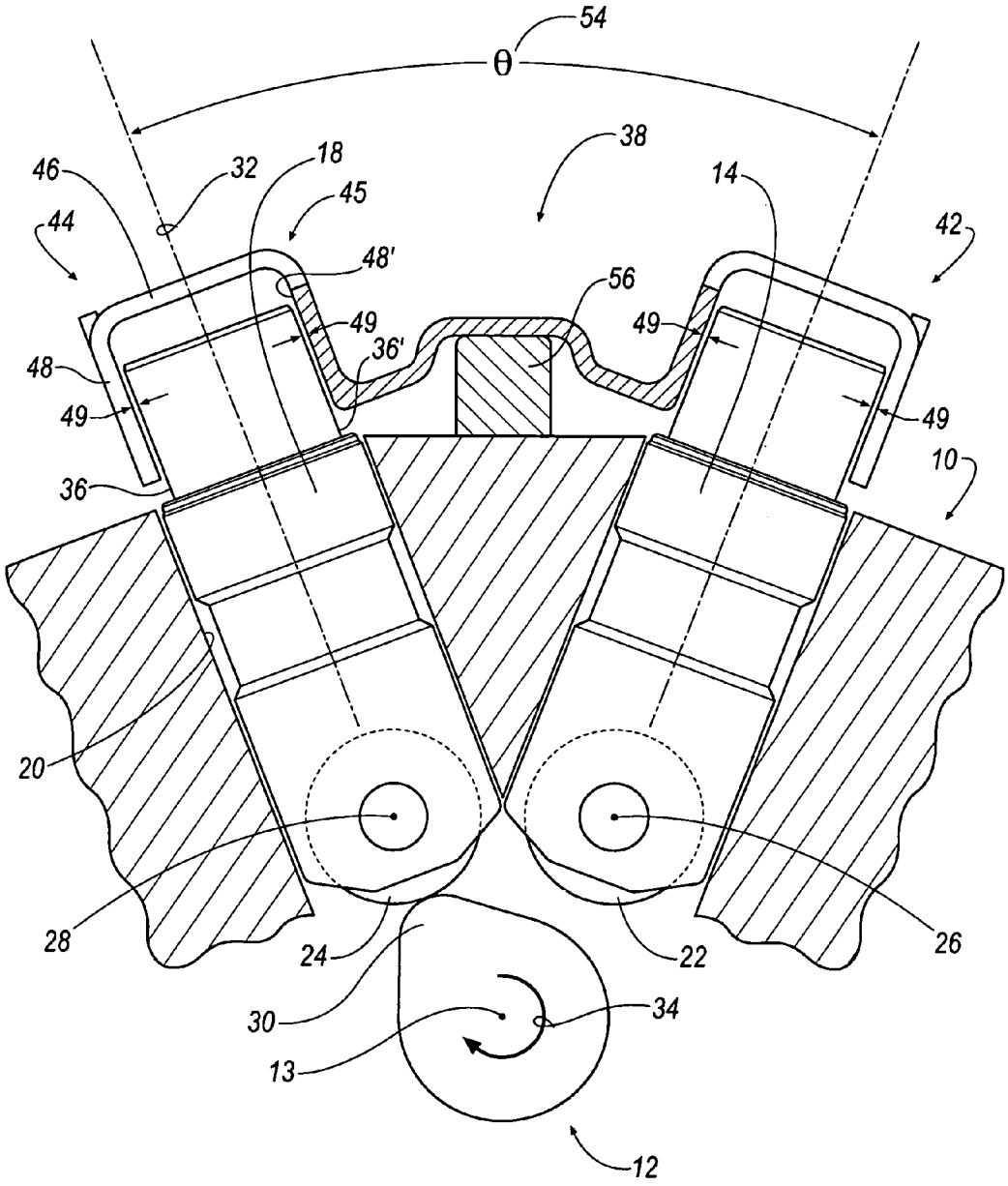
FIG. 3 is a partial cross section taken substantially through lines 3-3 of FIG. 2.

Now referring to FIGS. 1, 2, and 3, each valve lifter may be adapted to reside within a corresponding bore within block 10. For example, lifter 18 may be adapted to reside within bore 20. Each lifter may include a rotatable wheel (known as a "roller"). The rollers for lifters 14, 18 are referenced respectively as 22, 24 in FIG. 3. Each roller 22, 24 includes a respective axis of rotation 26, 28 wherein each roller 22, 24 is free to rotate about its respective axis of rotation 26, 28. Cam shaft 12 includes a plurality of lobes wherein each lobe can be respectively associated with a roller of a lifter. For example, in FIG. 3, lobe 30 of cam shaft 12 is associated with roller 24 of lifter 18. Each bore includes a longitudinal axis. For example, bore 20 includes longitudinal axis 32. Each lifter is free to reciprocate within its respectively associated bore along the longitudinal axis of its bore. For example, lifter 18 is free to reciprocate along longitudinal axis 32 of bore 20. The eccentric profile of cam lobe 30 causes lifter 18 to reciprocate along longitudinal axis 32 of bore 20 when cam shaft 12 rotates.

Although the lifters are free to reciprocate along (i.e. parallel to) the longitudinal axis of their respective bores, it is not desirable to have the lifters rotate about the longitudinal axis of their respectively associated bores. If such rotation occurs, the axis of rotation 28 of the associated roller 24 may not be parallel to the axis of rotation of cam shaft 12 and galling of the engagement surfaces between roller 24 and cam lobe 30 may take place (potentially causing premature wear of one or more component surfaces). Lifter alignment system 34 is used to prevent the lifters from rotating about the longitudinal axis of their respective bore while still allowing them to reciprocate along the longitudinal axis of their respective bore.

Each lifter includes a keyed surface. For example, lifter 18 includes keyed surface 36. Keyed surface 36 can be any type of irregularity formed in the lifter such that when the keyed surface is engaged, it prevents the lifter from rotating about the longitudinal axis of its respectively associated bore. In the embodiment shown herein, the keyed surface 36 of lifter 18 includes a flat portion 36 formed in a side surface of the lifter. Although forming a flat surface in a lifter is easily and economically accomplished, any number of keyed surface designs can be implemented such as eccentric surfaces, holes, depressions, raised protrusions and the like.

Lifter alignment system 38 includes a central body portion 40 which is flanked to its right by a right bank of lifter retaining arms 42 and to its left by a left bank 44 of lifter retaining arms. Each lifter retaining arm may include a spanning portion and a key engaging portion. For example, lifter retaining arm 45 (see FIGS. 1 and 3) includes spanning portion 46 and key engaging portion 48. Each lifter retaining arm may be respectively associated with a lifter. A groove may exist between adjacent lifter retaining arms. For example, FIG. 1 shows the presence of groove 50 between adjacent lifter retaining arms on the left lifter arm bank 44. Although the lifter alignment system 38 can be fabricated from any number of materials, it is contemplated that metal or plastic will be the least costly alternative. It is also contemplated that lifter alignment system can be fabricated from a single piece of material.

Now referring to FIGS. 2 and 3, once the lifters are placed within their respectively associated bores, lifter alignment system 38 is manipulated downwardly 52 over the lifters and assumes a position generally shown in FIGS. 2 and 3. It should be noted that due to the angle 54 formed by the longitudinal axes of the right 42 and left 44 bank of lifter retaining arms, that the lifter alignment system 38 will only properly engage the lifters if, when it is lowered downwardly 52, each lifter is generally aligned with a respective groove 50. If this is not the case, when the lifter alignment system 38 is lowered 52, the key engaging portion 48 of each lifter retaining arm 45 will collide with the upper portion of its respective lifter preventing the proper positioning of the lifter alignment system 38.

Figure 4:
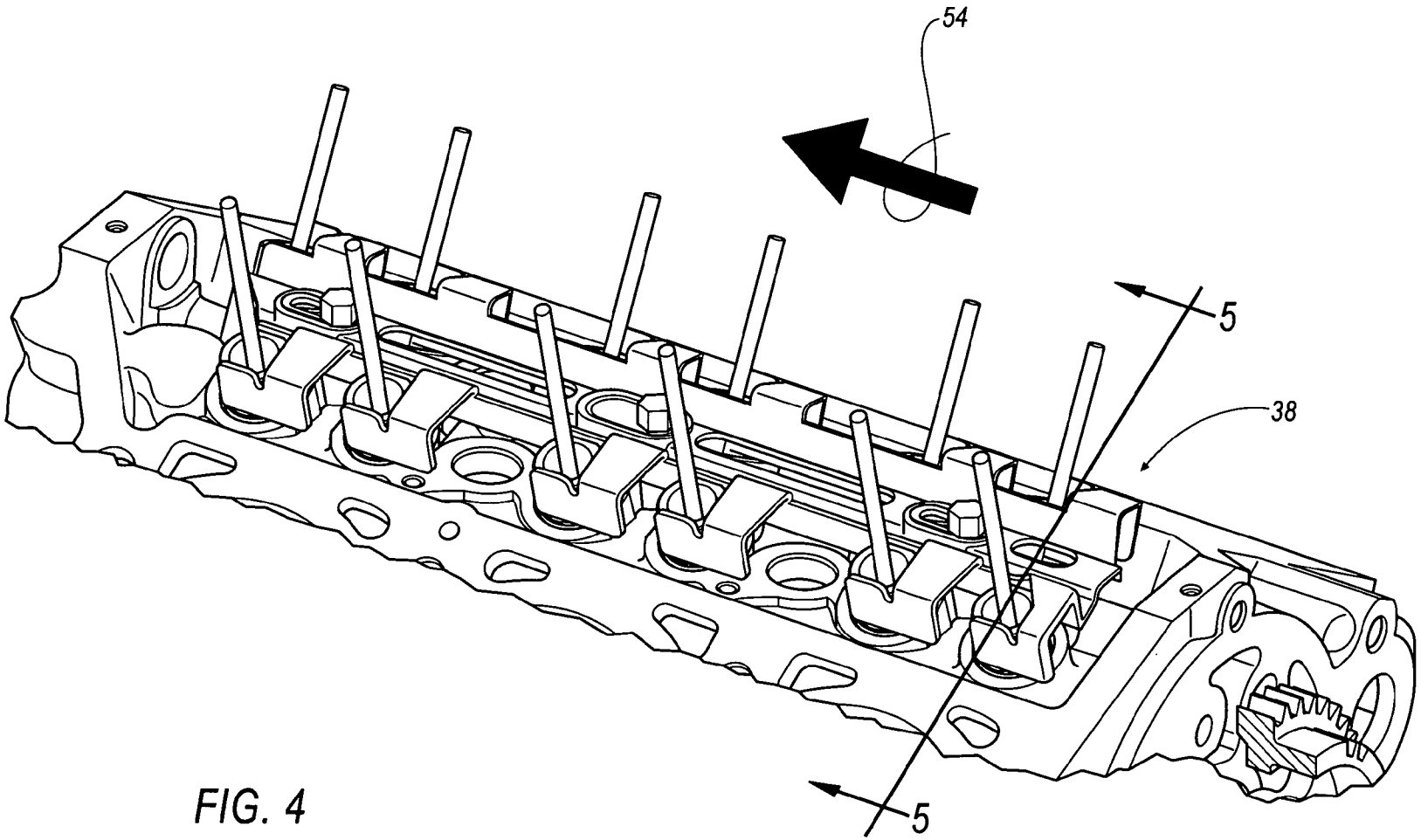
FIG. 4 is a partial view of the top portion of an engine block showing an embodiment of the lifter alignment system of the present invention in a locked position.
Figure 5:
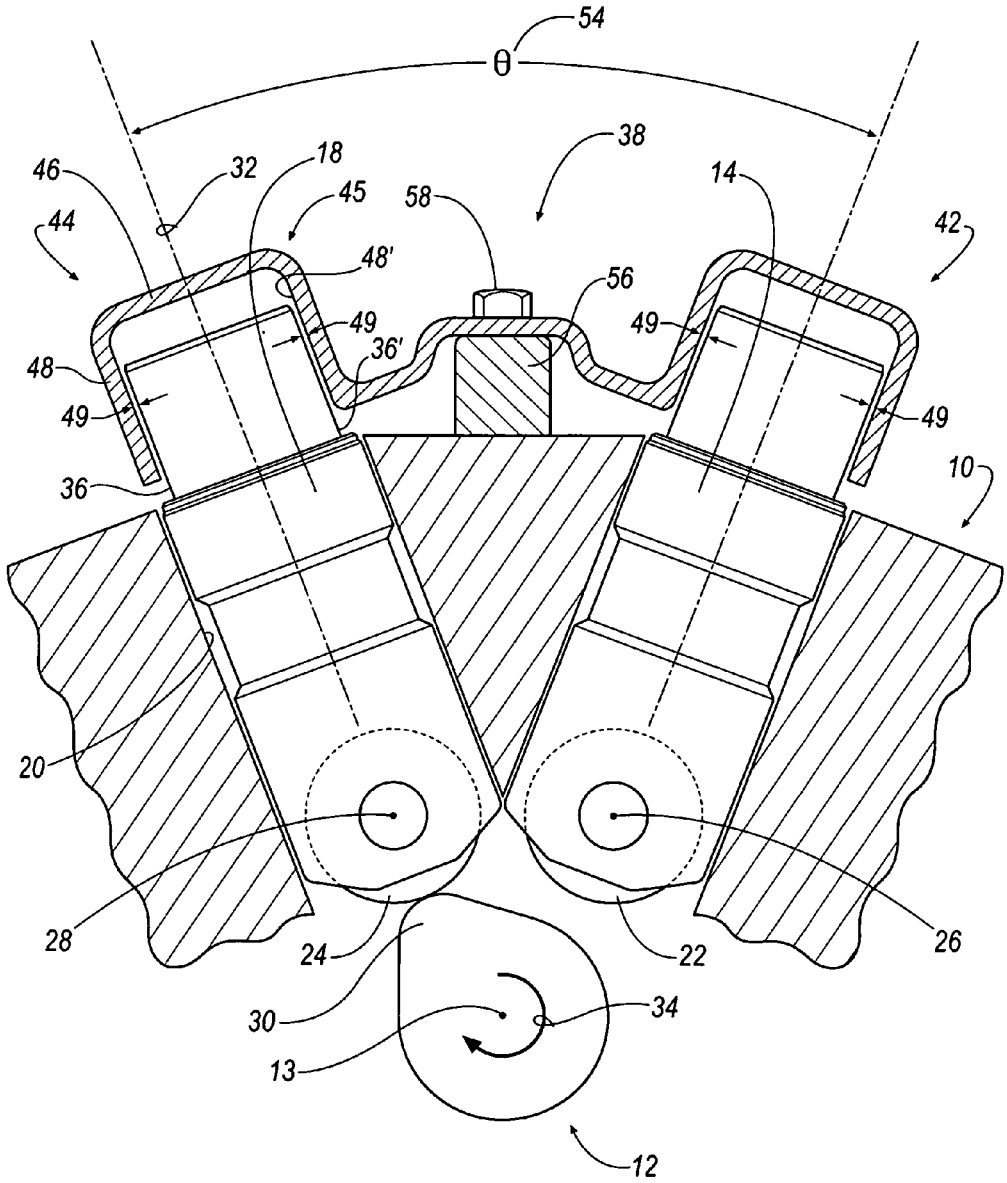
FIG. 5 is a partial cross sectional view taken substantially through lines 5-5 of FIG. 4.

After the lifter alignment system 38 has been lowered and resides in the position shown in FIGS. 2 and 3, lifter alignment system 38 is manipulated longitudinally 54 (see FIGS. 4 and 5) so that the key engaging portion of each lifter retaining arm engages the respectively associated keyed surface of its respective lifter. The engaged position of lifter alignment system 38 is generally shown in FIGS. 4 and 5 wherein the key engaging portion 48 of lifter retaining arm 45 is engaging the keyed surface 36 of lifter 18, thereby preventing lifter 18 from rotating about longitudinal axis 32 of bore 20. Lifter alignment system 38 can be maintained at the proper height by way of block bosses 56 that are positioned at one or more locations along a surface of engine block 10.

One or more fasteners 58 can be used to secure lifter alignment system 38 to block boss 56, thereby maintaining lifter alignment system 38 in its engaged position. Keyed surfaces 36 of each lifter are contacted by a respectively associated key engaging portion of a lifter retaining arm. In some applications, it may be desirable to fashion each lifter with more than one keyed surface. For example, FIG. 3 shows that not only does lifter 18 include keyed surface 36, it also includes keyed surface 36' which is generally opposite to keyed surface 36. If a second keyed surface is desirable, lifter retaining arm 45 can be formed so that a second key engaging portion 48' is formed therein duplicating the function (with respect to key engaging surface 36') that is served by key engaging portion 48 with respect to keyed surface 36.

Sufficient running clearances 49 must be made between surfaces 36, 36' and respectively associated key engaging portions 48, 48' in order to allow the lifters to freely reciprocate within bore 20; however, running clearances 49 cannot be made so great so as to allow the axis of rotation 28 of roller 24 to become substantially unaligned with the axis of rotation 13 of cam shaft 12.

Lifter alignment system 38 cannot be removed until all of the fasteners 58 are removed and system 38 is indexed longitudinally to the position shown in FIGS. 2 and 3. It is important to note that because lifter alignment system 38 can be made as a single unit, a simple longitudinal action 54 is effective for locking or unlocking all of the lifters in banks 42, 44 in a single motion. It is also important to note that because of the presence of grooves between adjacent lifter retaining arms (grooves exemplified at 50 in FIG. 2), it may be possible to remove lifter alignment system 38 once one of the cylinder heads (not shown) are removed without removing any push rods 16. The presence of grooves 50 between each adjoining lifter retaining arm make this design feature possible. The present invention not only eliminates numerous parts that are traditionally associated with lifter retention assemblies, but also eliminates the warranty costs associated with omitted or misassembled parts.

Having described various embodiments, it will be understood that various modifications or additions may be made to the embodiments without departing from the spirit of the present of the present invention. Accordingly, it is to be understood that the subject matter sought to be afforded protection hereby shall be deemed to extend to the subject matter defined in the appended claims, including all fair equivalents thereof.

What is claimed:

1. A lifter retainer, comprising:

a central body portion, a left bank of lifter retaining arms attached to said central body portion, and a right bank of lifter retaining arms attached to said central body portion, wherein each retaining arm includes a spanning portion and a key engaging portion, and each key engaging portion of each retaining arm is adapted to engage with a sufficient running clearance a keyed surface of a respectively associated lifter.

2. The lifter retainer of claim 1, wherein said central body portion, said left bank of lifter retaining arms, and said right bank of said lifter retaining arms are all formed from a common piece of material.

3. The lifter retainer of claim 2, wherein said material is metal.

4. The lifter retainer of claim 2, wherein said material is plastic.

5. The lifter retainer of claim 1, wherein each said bank of lifter retaining arms includes at least two adjacent lifter retaining arms, wherein said at least two adjacent lifter retaining arms are spaced apart from each other defining a groove therebetween.

6. The lifter retainer of claim 5, wherein said groove is sufficiently wide so that it allows a portion of a lifter to pass therebetween while assembling the lifter retainer to an engine block.

7. A lifter retainer, comprising:

a central body portion, a left bank of lifter retaining arms attached to said central body portion, and a right bank of lifter retaining arms attached to said central body portion, wherein each retaining arm includes a spanning portion, a first key engaging portion adapted to engage a first keyed portion of a lifter and a second key engaging portion adapted to engage a second keyed portion of said lifter, and each key engaging portion is adapted to engage with a sufficient running clearance each keyed portion of said lifter.

8. The lifter retainer of claim 7, wherein said first and second key engaging portions are opposite one another.

9. The lifter retainer of claim 1, wherein said central body portion includes a surface adapted to engage a boss portion of an engine block.

10. A lifter alignment system, comprising:

a central body, a first retainer for retaining a first bank of lifters, and a second retainer for retaining a second bank of lifters, wherein each retainer includes a spanning segment and a first key segment, and each key segment is adapted to engage with a sufficient running clearance a keyed surface of a respectively associated lifter.

11. The lifter alignment system of claim 10, wherein said first and second retainers and said central body are all formed from a common piece of material.

12. The lifter alignment system of claim 10, wherein said first key segment includes a partially flat surface.

13. The lifter alignment system of claim 10, wherein said first retainer includes at least first and second spaced retaining arms, wherein said spaced retaining arms define a groove that is sufficiently wide to allow a portion of a lifter to pass through the groove while assembling the lifter alignment system to an engine.

14. A lifter alignment system, comprising:

a central body, a first retainer for retaining a first bank of lifters, and a second retainer for retaining a second bank of lifters, wherein each retainer includes a spanning segment, a first key segment and a second key segment, and each key segment is adapted to engage with a sufficient running clearance a keyed surface of a respectively associated lifter.

15. The lifter alignment system of claim 10, wherein said central body includes a portion adapted to engage a boss portion of an engine.

* * * * *